United States Patent [19]

Lucas

[11] 3,993,275

[45] Nov. 23, 1976

[54] LADDER LIFTING AND LEVELING DEVICE

[76] Inventor: Edwin K. Lucas, 202 W. 18th St., Wilmington, Del. 19802

[22] Filed: Jan. 3, 1973

[21] Appl. No.: 320,722

[52] U.S. Cl. ..... 248/188.2; 182/49; 182/107; 182/200

[51] Int. Cl.[2] ..... E04G 5/02

[58] Field of Search ..... 248/188.2; 182/107, 182/109, 200; 272/56.5 R

[56] References Cited

UNITED STATES PATENTS 1,915,320 6/1933 Jones ..... 248/188.2

D190,125 4/1961 Ahrens ..... 272/56.5 R

FOREIGN PATENTS OR APPLICATIONS 1,247,577 8/1967 Germany ..... 248/188.2

*Primary Examiner*—Roy D. Frazier
*Assistant Examiner*—Robert W. Gibson, Jr.
*Attorney, Agent, or Firm*—Plumley and Tyner

[57] ABSTRACT

A safety device for supporting legs or feet of a ladder or similar structure which is a one-piece combination of an inclined plane and a series of steps providing a multiplicity of levels on which said structure may be supported.

4 Claims, 2 Drawing Figures

LADDER LIFTING AND LEVELING DEVICE

This invention relates to a one-piece safety device adapted for simultaneously lifting, leveling, supporting and holding in place a ladder, in one motion, so as to enable a ladder to stand vertically on a gradient or on uneven ground or both while concurrently preventing slippage.

Many suggestions have been made in the area of non-slipping devices for ladders, but previously such devices have been essentially for use on level ground and they have consisted primarily of devices which are made an integral part of the ladder and also fixed or adjustable on the bottom of the ladder or on the ladder feet. Similarly many suggestions have been made of devices for adjusting the feet or legs of ladders and other structures in order to cause them to rest securely and firmly on an uneven surface. Again, such devices have been of the nature of an extensible leg or foot by way of an adjustable jack or screw-like device which is either made an integral part of the ladder or which can be firmly attached thereto.

Some of the disadvantages of previously disclosed devices of the foregoing nature for lifting, leveling, supporting and holding in place a ladder reside in the facts that they add considerable weight to a given ladder, or cannot be used on more than one ladder, or the ladder on which they are mounted or to which they are attached cannot be moved without considerable time and effort in readjusting the safety device when it is desired to use the ladder in another spot or position, or more than one device must be employed to guard against the two basic hazards — slippage and/or falling — for which there has been previously no one single device.

It is an object of the present invention to overcome the disadvantages of the prior art and to supply a safety device which is relatively light in weight, is simple and inexpensive to fabricate, and is not attached to the ladder, which can used with any ladder, and which can be used to level the legs or feet of a ladder practically instantaneously on any type of uneven surface by one person working alone in any given working space, in one motion.

Other objects and advantages of my invention will be apparent from the following description.

My invention comprises a combination of a series of steps and an inclined plane separated by a brace or ridge, which is between them, that acts as a stop to prevent slippage of a ladder foot from the inclined plane portion of my safety device to the series of steps portion of my safety device and vice versa; and provided also with a brace or ridge on the outer edge of each step and also on the outer edge of the inclined plane which act as a stop to prevent slippage of a ladder foot and loss of contact with my safety device.

Figure 1:
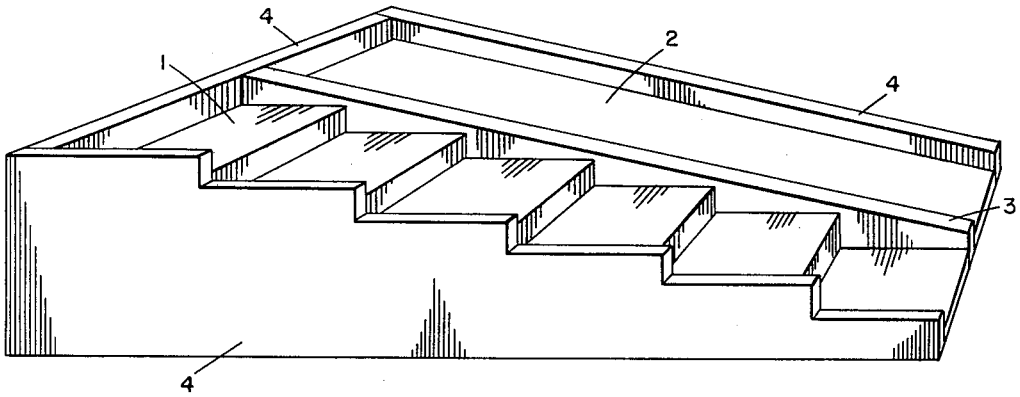
Figure 2:
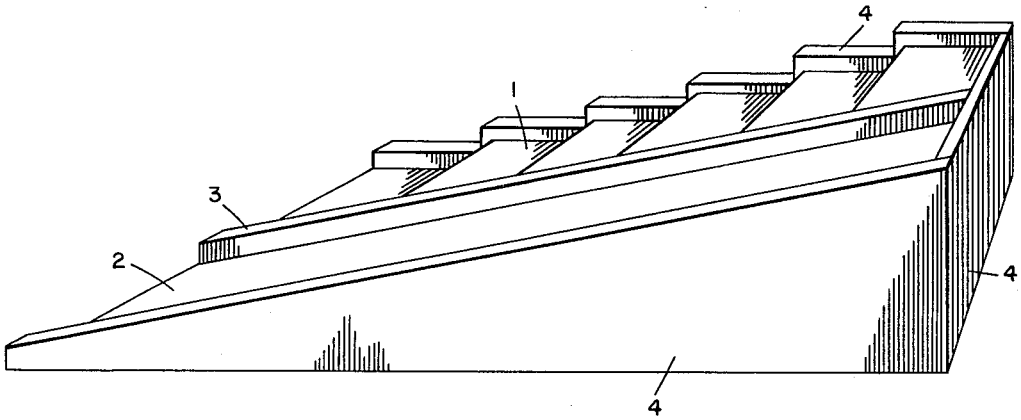

My invention will be further described, and in more detail, by reference to the drawings in which:

FIG. 1 is a perspective view of my safety device with the side depicting the series of steps forward; and FIG. 2 is also a perspective view of the same device with the side depicting the inclined plane forward.

In the safety device of this invention the series of steps, 1, and the inclined plane 2 are separated by a central ridge or brace 3 which acts as a stop to prevent a ladder foot from slipping from one of the steps 1 to the inclined plane 2 or vice versa. Firmly attached to and thus made a part of the inclined plane 2 and each of the steps 1 are stops 4 which serve to prevent slippage of the ladder foot from support by one of the steps 1 or from the inclined plane 2.

In use, the device of this invention assures a retention of plumb once established by customary means (described later) under any conceivable circumstance up to the maximum height of the device. It can be used lengthwise at an angle or sideways when space is limited, the center ridge always providing a stop. It can be used with wood or metal ladders or the like with or without attached feet. When the surface on which the ladder rests is sloping in any direction, the step side may be used to hold the ladder leg or foot at the proper height, and if the precise amount of lift needed lies between one step and another the inclined plane side may be utilized.

When the surface is uneven, the inclined plane side may be used to level the leg or foot, and if the precise amount of level needed fits a side step, the step may be employed.

When the surface is sloping and uneven, the inclined plane side or the step side may be used. This is determined by moving the device circularly and in and out of position until the leg or foot of the ladder touches the device or vice versa.

The device may be pointed in any direction, at right angles or parallel to the foot or leg or any degree in between; and it invariably works out in practice that as the device is fitted in, either the inclined plane or a step provides the lift, leveling, supporting and holding in one place required.

If the device were two devices, it would not work, as the continuum of lift, level, support and hold would not be realized by one unit of work motion by one individual.

The device, in sum, is made of straight lines but gives the 360° results of an unbroken circle, and although solid in structure, is, in effect, as elastic as rubber without requirement that it be fabricated from resilient material.

Among the important advantages of this invention are the facts that it obviates the carrying of different sized sticks, wedges, stones, bricks, pieces of cardboard and the like — which are undependable and a dangerous method of ladder-lifting and leveling at best — and the user has in one light weight, compact unit a device which both levels and lifts a ladder easily with safety and security. Actually, the device of this invention can be employed satisfactorily and safely with a man's foot, the procedure being to place the device under the ladder foot to be lifted or leveled or both, both hands being employed to place the ladder in proper position and then moving the safety device in the direction needed to place the step or inclined plane portion at the proper spot for even support whereby the ladder remains plumb.

The device of this invention can be constructed of wood, plastic or metal, the component parts being firmly joined to form one solid unit by nailing or by screws or by use of adhesives or by welding in the case of metal materials of construction or molded of various and sundry materials, e.g. plastic, aluminum, etc.

The size of my safety device is not critical although I prefer to have the steps with about ¼ to ⅜ inch risers and with a total number of steps of from 3 for household use to 9 for industrial use. Thus the total lift of the steps would range from about ¾ to 1 inch to 2¼to 3⅜inches. Similarly the inclined plane portion of my safety device would, preferably, range from ¼ inch at the low end to 2¼or 3⅜inches at the most elevated end. The ridge or center brace can vary considerably in height and width but preferably it extends about ½ an inch above the top most step and the highest point of the inclined plane, and extends outwardly from this point to the lower end of the device, having a height of about 3¼or 4⅜inches at its maximum. If desired for simplicity of construction the ridge or center brace can be constructed of a board or equivalent plastic or metal material. As a further modification of my safety device, I prefer to provide a stop or stops on the outer sides of both the series of steps and the inclined plane portions. These stops can be solid supporting members as depicted 4 on the sides of my device in FIGS. 1 and 2, or separate strips on the outer side of each step and along the outer edge of the inclined plane. In either event they should extend upwards from each step and from the inclined plane sufficiently to prevent or stop the movement of a ladder foot, preferably ½ to ¾ inch.

In employing my safety device I have found in the case of house painting, for example, the most satisfactory procedure is as follows. The ladder should be placed at a distance from the house to be painted which is equal to one fourth of the height at which the ladder touches the house. The top of the ladder is then allowed to rest against the house and tested for firmness and plumb. If one ladder foot is not resting solidly on the ground or supporting surface, then the safety device is placed under said foot and, manually or by the painter's foot, pushed under said ladder foot until a step is reached which appears to level the ladder. The ladder is then brought away from the house a few feet and then allowed to gently fall back to the house to be sure the top strikes in the same position it was before. If the ladder feet are firm and the top of the ladder touches the house evenly then it is safe to climb. That is the customary method of determining plumb. If further adjustment is necessary and the next higher or lower step does not quite furnish a level support, then the inclined plane is manipulated under the ladder leg and an exact leveling can be obtained by following the procedure described in connection with the steps. It will be seen that the safety device of this invention thus provides, in one compact unit, and in one motion, a result which may be obtained with any ladder or ladder-like structure which it is desired to level, and to give quick accurate, safe, level support.

While I have illustrated and described the preferred form and construction for carrying my invention into effect, there are variations and modifications which may be made without departing from the spirit of my invention and which come within the scope of the following claims.

What is claimed is:

1. A hand portable leveling and supporting device adapted to be readily moved by hand or foot into and out of supporting relationship with the foot of a ladder comprising the combination in one unit of an inclined plane and a series of flat steps separated from said inclined plane by a center ridge adapted to act as a stop for said ladder foot and to prevent slippage of said foot from a step to the inclined plane and vice versa, said series of steps and said inclined plane having on their outside edges a member adapted to act as a stop for said ladder foot and to prevent slippage of said foot from said supporting device.

2. A hand portable leveling and supporting device sufficiently light weight as to be readily moved by foot or hand into and out of supporting relationship with the foot of a ladder comprising the combination in one unit of an inclined plane and a series of flat steps separated from said inclined plane by a center ridge adapted to act as a stop for said ladder foot and to prevent slippage of said foot from a step to the inclined plane and vice versa, said series of steps and said inclined plane having on their outside edges a member adapted to act as a stop for said ladder foot and to prevent slippage of said foot from said supporting device.

3. A hand portable leveling and supporting device adapted to support the foot of a ladder comprising the combination in one unit of an inclined plane and a series of about three to nine flat steps separated from said inclined plane by a center ridge adapted to act as a stop for said ladder foot and to prevent slippage of said foot from a step to the inclined plane and vice versa, said series of steps and said inclined plane having on their outside edges a member adapted to act as a stop for said ladder foot and to prevent slippage of said foot from said supporting device, said inclined plane ranging in height from about ¼ inch at the low end to about 3⅜inches at the most elevated end, and the riser of each step ranging from about ¼ to ⅜ inch.

4. A hand portable leveling and supporting device which, when placed on the ground, is adapted to support the foot of a ladder consisting essentially of the combination in one unit of an inclined plane and a series of flat steps separated from said inclined plane by a center ridge adapted to act as a stop for said ladder foot and to prevent slippage of said foot from a step to the inclined plane and vice versa, said series of steps and said inclined plane having on their outside edges a member adapted to act as a stop for said ladder foot and to prevent slippage of said foot from said supporting device.

* * * * *